United States Patent [19]

Fukushima et al.

[11] 4,276,495

[45] Jun. 30, 1981

[54] ELECTRON GUN FOR CATHODE-RAY TUBE

[75] Inventors: Masakazu Fukushima, Kokubunji; Kunio Ando, Yokohama; Kenichi Fukuzawa, Mobara, all of Japan

[73] Assignee: Hitachi, Ltd., Tokyo, Japan

[21] Appl. No.: 911,804

[22] Filed: Jun. 2, 1978

[30] Foreign Application Priority Data

Jun. 15, 1977 [JP] Japan ..... 52/69841

[51] Int. Cl.[3] ..... H01J 29/46; H01J 29/56

[52] U.S. Cl. ..... 315/16

[58] Field of Search ..... 315/14, 15, 16, 382, 315/31 TV

[56] References Cited

U.S. PATENT DOCUMENTS

| | | | |
|---|---|---|---|
| Re. 25,127 | 2/1962 | Szegho | 315/16 |
| 3,049,641 | 8/1962 | Gleichauf | 315/16 |
| 3,852,637 | 12/1974 | Yamazaki et al. | 315/16 |
| 3,863,091 | 1/1975 | Hurukawa et al. | 315/16 X |
| 3,895,253 | 7/1975 | Schwartz et al. | 315/16 |
| 3,987,329 | 10/1976 | Yamazaki et al. | 313/449 |

*Primary Examiner*—Theodore M. Blum

*Attorney, Agent, or Firm*—Craig and Antonelli

[57] ABSTRACT

In an electron gun for cathode-ray tube comprising a lens system constructed by four cylindrical electrodes concentrically arranged apart from each other for focusing electron beams emitted from a cathode, these electrodes are applied with proper voltages so as to form a bipotential type focusing lens and a unipotential type focusing lens. Preferably, the length of the electrode in the unipotential type focusing lens lying at the cathode side is selected to be larger than a half of the inner diameter of the electrode.

4 Claims, 9 Drawing Figures

ELECTRON GUN FOR CATHODE-RAY TUBE

The present invention relates to an electron gun and more particularly to an electron gun for cathode-ray tube.

The present invention as well as the prior art will be explained in conjunction with the following detailed description referring to the accompanying drawings, in which.

Figure 2:
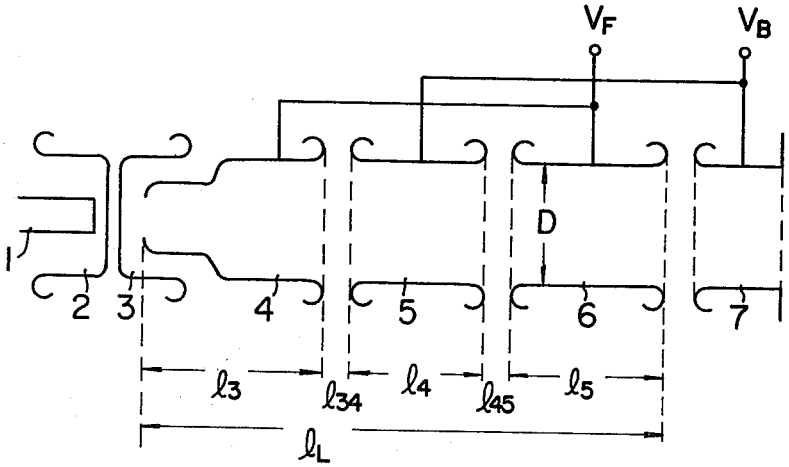
FIG. 2 is a cross-sectional view showing the schematic arrangement of an electron gun as an embodiment of the present invention.
Figure 5:
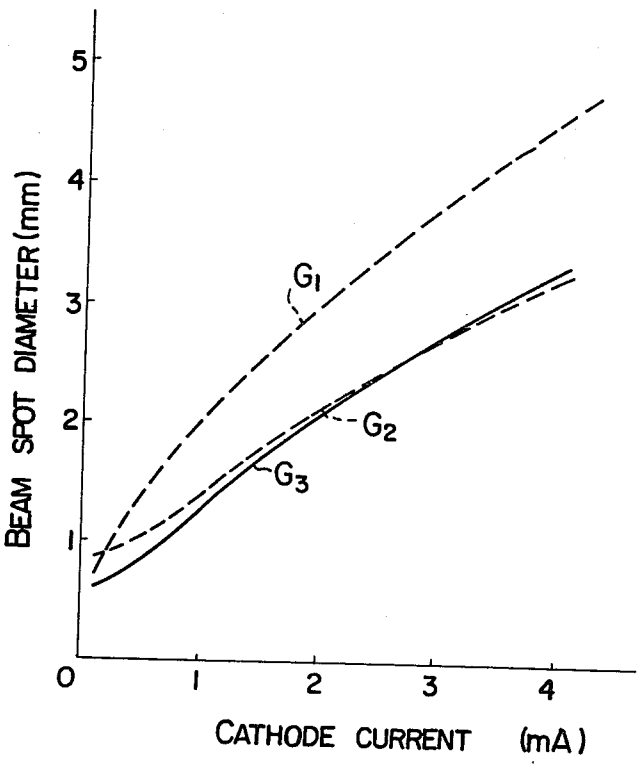
Figure 4:
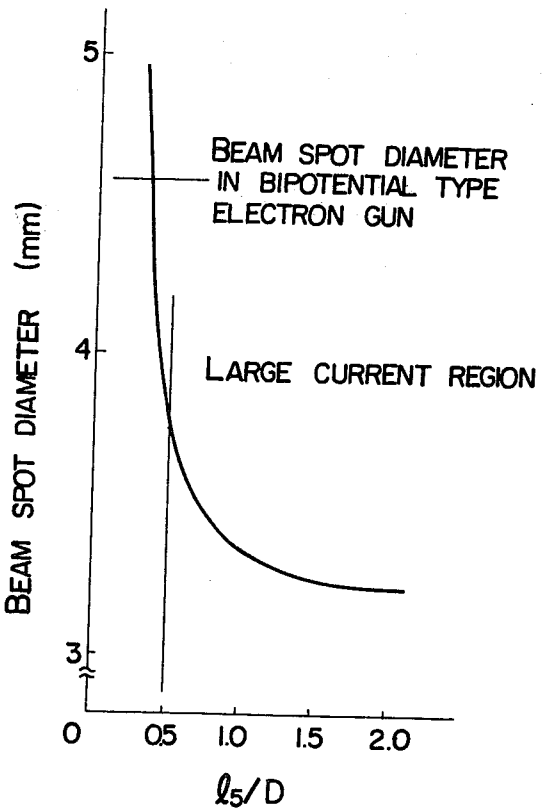
Figure 6:
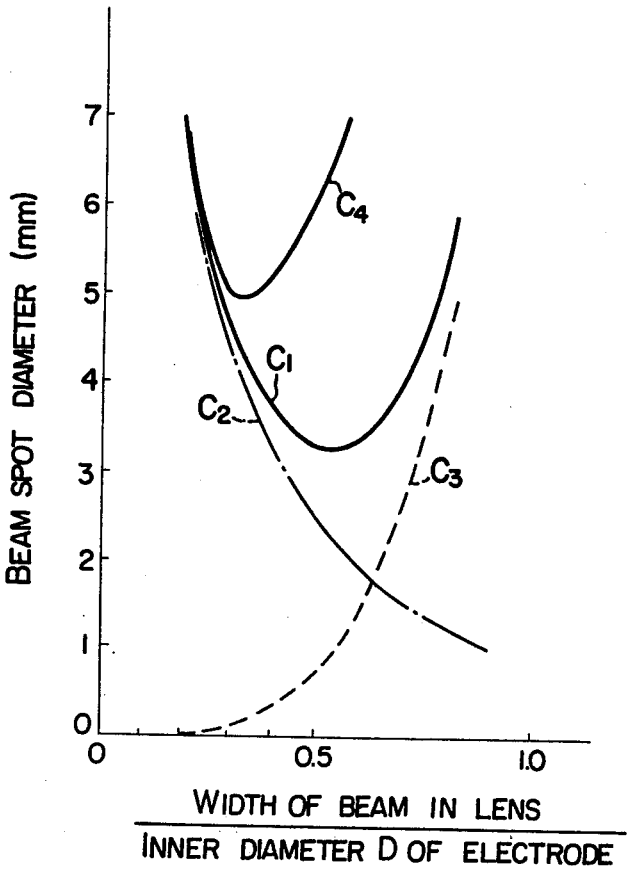
Figure 7A:
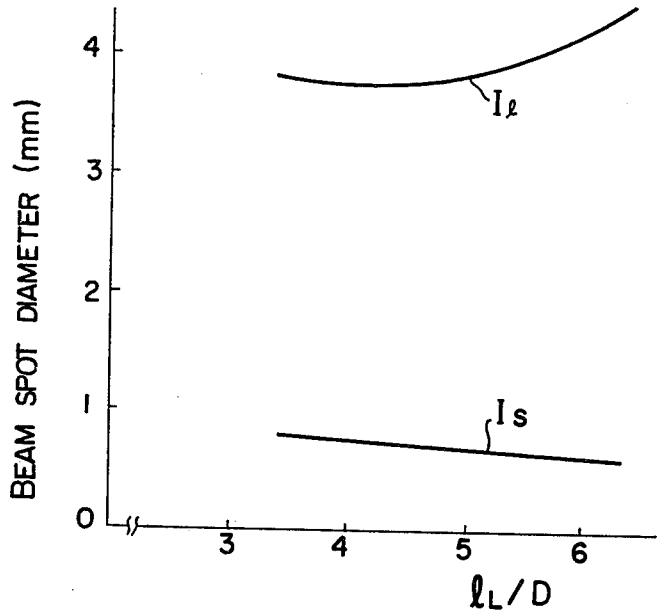
Figure 7B:
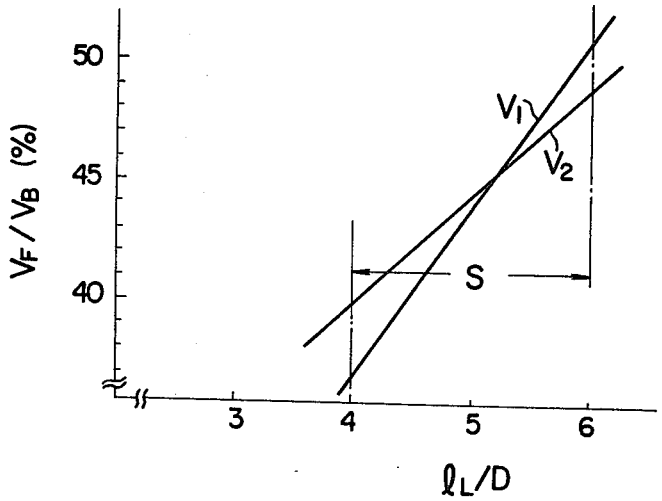

FIG. 4 graphically shows the variation of electron beam spot diameter produced for a large current operation region when the length of the fifth grid in the lens system of the present invention is changed while the length of the lens system is kept constant;

FIG. 5 is a graph showing the relationship between cathode currents and electron beam spot diameters for the conventional electron gun using a bipotential type lens, the electron gun shown in FIG. 2 using a unipotential type lens and the electron gun using the lens system of the present invention;

FIG. 6 is an explanatory view showing the variations, with respect to the width of electron beam in the lens system of the electron gun of the present invention, of a component of the beam spot diameter determined by the thermal velocity spread and the space charge effect, a component of the beam spot diameter determined by the spherical aberration of the lens system and the actual beam spot diameter determined by the combination of these effects, the figure also showing the variation of the beam spot diameter for the conventional electron gun using a bipotential lens system; and FIGS. 7A and 7B are graphs respectively showing the variation of the beam spot diameter and the variation of the focusing voltage with respect to the length of the lens portion of the electron gun of the present invention.

Conventionally, two kinds of a unipotential type and a bipotential type have been most popularly used as a focusing lens of the electron gun for cathode-ray tube.

Figure 1:
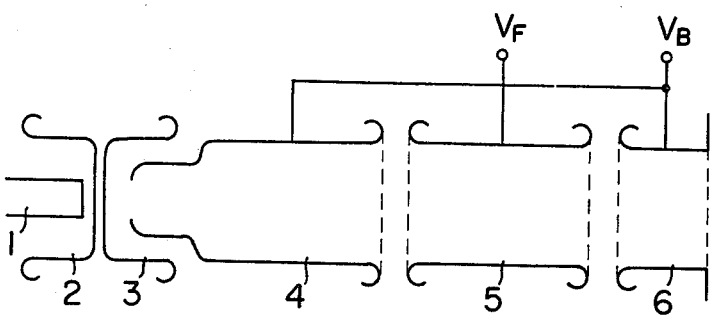
FIG. 1 PRIOR ART
FIG. 1 is a cross-sectional view showing the arrangement of a unipotential type electron gun which has already been proposed by the present inventors.

In order to minimize a spherical aberration due to the conventional unipotential type lens system, the present inventors have already proposed, in Japanese Patent Application No. 51-126041 filed on Oct. 22, 1976 (Japanese Patent Laid-Open Application No. 51958 laid open on 1978), a lens system as shown in FIG. 1.

Referring to FIG. 1, electron beam currents emitted from a cathode 1 are controlled by first and second grids 2 and 3 to form crossovers. The crossover image is projected onto a phospher screen (not shown) by means of a lens system constructed by three cylindrical electrodes including third, fourth and fifth grids 4, 5 and 6, thereby obtaining electron beam spots.

In a usual unipotential type lens system, it is frequent that a voltage $V_B$ supplied to the phosphor screen electrode (not shown) is applied to the third and fifth grids 4 and 6 while a focusing voltage $V_F$ selected to be near zero is applied to the fourth grid 5. However, in order to cause this focusing voltage to be zero, it is difficult from the relation with the lens strength to render the length of the fourth grid 5 longer than a half of the inner diameter D of the electrode.

In the lens system of the above-described type, when the length of the fourth grid 5 as a focusing electrode to the inner diameter thereof is increased, the focusing voltage remarkably increases and simultaneously the spherical aberration remarkably decreases. An electron gun using such a lens system can provide a smaller electron beam spot diameter in comparison with the conventional electron gun using a bipotential type lens system.

An object of the present invention is to improve the above-described unipotential type electron gun and to provide an electron gun which can provide a reduced electron beam spot diameter to minimize the spherical aberration.

According to one aspect of the present invention, there is provided an electron gun for cathode-ray tube comprising a lens system for focusing electron beam emitted from a cathode, wherein said lens system includes first, second, third and fourth cylindrical electrodes arranged in this order from the side of said cathode, and said first and third electrodes are applied with the same voltage while said second and fourth electrodes are applied with a voltage supplied to a phosphor screen electrode so that a bipotential lens is formed by said first and second electrodes and a unipotential lens is formed by said second, third and fourth electrodes.

According to another aspect of the present invention, there is provided an electron gun for cathode-ray tube comprising a lens system for focusing electron beams emitted from a cathode, wherein said lens system includes first, second, third and fourth cylindrical electrodes arranged in this order from the side of said cathode, and said first and third electrodes are respectively applied with different voltages while said second and fourth electrodes are applied with a voltage supplied to a phosphor screen electrode so that a bipotential lens is formed by said first and second electrodes and a unipotential lens is formed by said second, third and fourth electrodes.

FIG. 2 shows an embodiment of the electron gun arrangement using a lens system according to the present invention. The electron gun comprises a cathode 1, a first grid 2, a second grid 3, and a lens system constructed by four cylindrical electrodes including third, fourth, fifth and sixth grids 4, 5, 6 and 7. The fourth and sixth grids 5 and 7 are electrically connected and are applied with a phosphor screen voltage $V_B$ supplied with a phosphor screen electrode (not shown). On the other hand, the third and fifth grids 4 and 6 are electrically connected and is applied with a focusing voltage $V_F$. With the application of such voltages, a unipotential lens is formed by the fourth, fifth and sixth grids 5, 6 and 7 while a bipotential lens is formed by the third and fourth grids 4 and 5.

In this embodiment, since the voltage $V_F$ applied to the third grid 4 is selected to a value of one-half to one-tenth of the third grid voltage $V_B$ in the above-described unipotential type electron gun shown in FIG. 1, a potential gradient developed between the second and third grids 3 and 4 is lowered so that the spherical aberration due to a focusing lens formed by these grids 3 and 4 is remarkably reduced. On the other hand, the fifth grid 6 constituting a principal part of the lens system has an effect similar to the fourth grid 5 of the unipotential type electron gun shown in FIG. 1: namely, the longer the length of the grid electrode, the smaller the spherical aberration due to the lens system becomes.

Figure 3A:
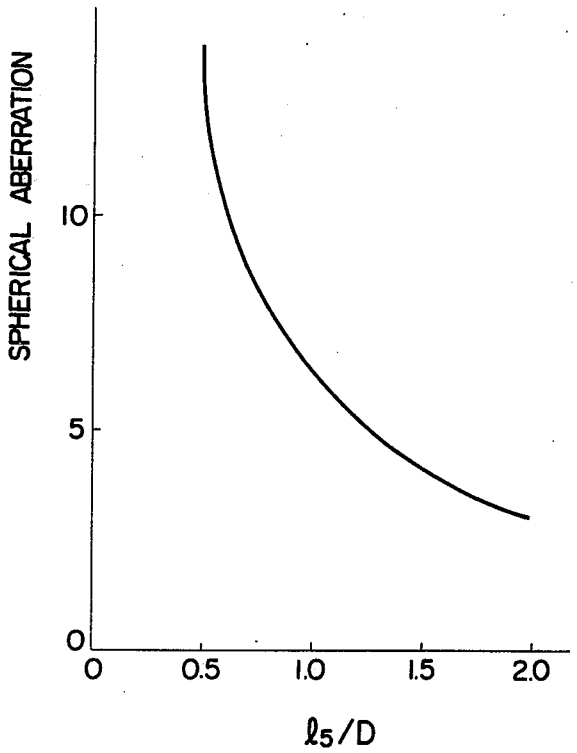
FIGS. 3A and 3B are graphs respectively showing the variation of the spherical aberration and the variation of the focusing voltage when the length of the fifth grid electrode in the lens system of the present invention is changed.
Figure 3B:
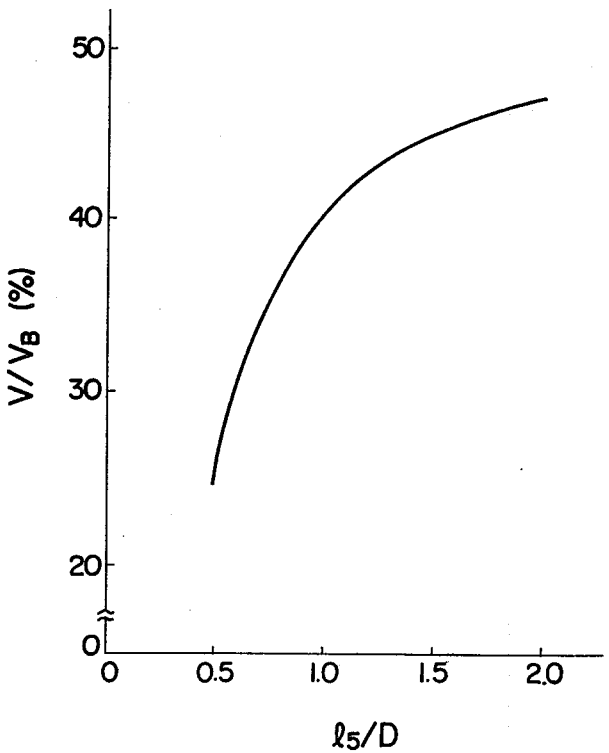

FIGS. 3A and 3B respectively shows the analytical results of the variation of the spherical aberration and the variation of the focusing voltage in the case where the length $l_5$ of the fifth grid 6 in the lens system of the electron gun of the present invention is changed. It is seen from FIG. 3 that in the electron gun of the present invention the longer the length of the fifth grid 6, the smaller the spherical aberration due to the lens system becomes and the higher the focusing voltage becomes.

It should be noted that the graphs of FIGS. 3 through 7 show the results obtained in the case of three-gun type and 110°-deflection type 20-inch screen size color cathode-ray tubes when the phosphor screen voltage $V_B$ of 18 KV is employed.

FIG. 4 shows the measured results of the variation of electron beam spot diameter produced for a large current operation region in the case where in the electron gun arrangement of the present invention the length $l_5$ of the fifth grid 6 is changed while the length $l_L$ of the lens system is kept constant. From FIG. 4, it is seen that the length $l_5$ longer than a half of the inner diameter D of the grid electrode is required in order to obtain a small beam spot diameter in the large current operation region.

FIG. 5 shows the measured results of the electron beam spot diameters to the cathode currents for the electron gun $G_1$ using a bipotential type lens, the electron gun $G_2$ shown in FIG. 1 using a unipotential type lens and the electron gun $G_3$ of the present invention. The spot diameter for the large current operation region in the electron gun of the present invention is reduced to seven-tenths of that in the case of the conventional bipotential type electron gun and the deterioration of the spot diameter observed in the case of the unipotential type electron gun does not take place even in a small current operation region. In the small current operation region, the reduction of the spot diameter is realized.

FIG. 6 shows at curve $C_1$ the variation of the electron beam spot diameter formed on the phosphor screen when the width of electron beam in the lens system of the electron gun of the present invention is changed at the time of large current operation. This characteristic can be explained as a combination of two reciprocal effects. Namely, a component of the beam spot diameter determined by the thermal velocity spread of electrons in the electron beam and the space charge effect (see curve $C_2$ in the figure) decreases with the increase in width of the electron beam in the lens system, whereas the size of the disk of least confusion produced by the spherical aberration due to the lens system, i.e. a component of the beam spot diameter determined by the spherical aberration (see curve $C_3$ in the figure) increases in proportion to the third power of the width of electron beam. Accordingly, the actual electron beam spot diameter determined by the combination of these effects has its minimum value at a certain specified point, as in shown at the curve $C_1$. With the electron gun of the present invention, the spot diameter on the phosphor screen has its minimum value when the width of electron beam in the lens system at the large current operation region is larger than a half of the inner diameter of the grid electrode. Curve $C_4$ in FIG. 6 represents the variation of the electron beam spot diameter when the conventional electron gun using a bipotential type lens is used. The curve $C_4$ shows that the spot diameter has its minimum value where the width of electron beam in the lens is one-third of the inner diameter of the cylindrical lens electrode. By the comparison of the curves $C_1$ and $C_4$ in FIG. 6, it is understood that a smaller spot diameter compared with the conventional bipotential type electron gun can be provided in the electron gun of the present invention by selecting the electron beam width in the lens system larger than one-third of the inner diameter of the cylindrical lens electrode arrangement.

FIGS. 7A and 7B respectively show the variation of the electron beam spot diameter and the variation of the focusing voltage $V_F$ in large and small current operation regions with respect to the length $l_L$ of the principal part of the lens system, for the electron gun of the present invention, when the length $l_5$ of the fifth grid 6 is selected to 1.7 D. The spot diameter for the large current operation region $I_l$ shown in FIG. 7A has its minimum value at $l_L$=4D. In FIG. 7A, $I_s$ represents the small current operation region. On the other hand, with respect to the focusing voltage $V_F$ shown in FIG. 7B, it is seen that there is such a condition that a certain coincident value for large and small current operation regions exists at $l_L$=5.3D so that any adjustment of the focusing voltage depending on the electron beam current is unnecessary. In FIG. 7B, $V_1$ and $V_2$ represent the focusing voltages for large and small current operation regions respectively and S represents a practical region.

Since it is very difficult to dynamically adjust a focusing voltage by use of an electronic circuit in accordance with the beam current of a cathode-ray tube in its operating state and such an adjustment is less practical from the economical point of view, the characteristic of the electron gun to operate with a constant focusing voltage irrespective of the beam current is very preferable.

The reason why the focusing voltage becomes constant in the present invention is as follows. If the electron beam current increases, a beam spot to be formed on the phosphor screen falls beyond the phosphor screen since the crossover is displaced toward the phosphor screen side and the space charge effect in the beam is increased. In order to correct such a phenomenum, the focusing ability of the lens system must be enlarged or the fifth grid voltage in the electron gun of the present invention must be lowered. On the other hand, the increase of the beam current correspondingly causes the increase in the angle of divergence of the electron beam from the crossover, thereby increasing the spherical aberration of the lens system so that the disk of least confusion moves from the phosphor screen toward the cathode side. Therefore, if the spherical aberration due to the lens system and the width of beam in the lens system are selected such that the above two effects are offset from each other, there exists a condition that the focusing voltage becomes constant irrespective of the current, as is shown in FIG. 7B.

In the electron gun of the present invention, the variation the spherical aberration due to the lens system is relatively small at a range of $l_L$ shown in FIG. 7A since the length of $l_5$ of the fifth grid 6 is made constant. On the other hand, the width of electron beam in the lens system approximately increases in proportion to $l_L$. Accordingly, it can be said that the characteristic of the lens system of the present invention may be determined by $l_L$. From this aspect, it is preferable to select the range of $l_L$ within a range from 4D to 6D.

As described above, the electron gun of the present invention provides very excellent effects that the electron beam spot diameter reduced to the seven-tenths of that in the case of the conventional gun is obtained irrespective of the beam current and that the gun of the present invention operates with a fixed focusing voltage irrespective of the beam current.

Though in FIG. 2 the same focusing voltage $V_F$ has been applied to the third and fifth grids 4 and 6, different voltages may be applied. Also, it is not necessary that the inner diameters of the cylindrical grid electrodes constituting the lens system are all the same.

What is claimed is:

1. An electron gun for cathode-ray tube comprising a lens system for focusing electron beams emitted from a cathode, wherein said lens system includes first, second, third and fourth cylindrical electrodes having substantially the same inner diameter and arranged in this order from the side of said cathode, the length of said third electrode is selected to be larger than a half of the inner diameter of said third electrode, and said first and third electrodes are applied with the same voltage while said second and fourth electrodes are applied with a voltage supplied to a phosphor screen electrode so that a bipotential lens is formed by said first and second electrodes and a unipotential lens is formed by said second, third and fourth electrodes.

2. An electron gun according to claim 1, wherein the width of the electron beam in said lens system is selected to be larger than one-third of the inner diameter of the cylindrical electrode arrangement.

3. An electron gun according to claim 1, wherein the total length of said lens system is selected to be within a range from four times to six times of the inner diameter of the cylindrical electrode arrangement.

4. An electron gun according to claim 1, wherein a focusing voltage selected to be within a range from one-fourth to a half of the phosphor screen electrode voltage is applied to said first and third electrodes.

* * * * *